US008127404B2

(12) United States Patent
Matassa

(10) Patent No.: US 8,127,404 B2
(45) Date of Patent: Mar. 6, 2012

(54) DECORATIVE JEWELLERY

(76) Inventor: Renata Matassa, Ballycullen (IE)

( * ) Notice: Subject to any disclaimer, the term of this patent is extended or adjusted under 35 U.S.C. 154(b) by 857 days.

(21) Appl. No.: 12/063,103

(22) PCT Filed: Aug. 9, 2006

(86) PCT No.: PCT/IE2006/000084

§ 371 (c)(1),
(2), (4) Date: Jul. 30, 2008

(87) PCT Pub. No.: WO2007/020614

PCT Pub. Date: Feb. 22, 2007

(65) Prior Publication Data

US 2010/0293699 A1 Nov. 25, 2010

(30) Foreign Application Priority Data

Aug. 12, 2005 (IE) ..... S2005/0534

(51) Int. Cl.
*A44C 25/00* (2006.01)

(52) U.S. Cl. ..... 24/3.11; 63/20; 63/33; 63/40; 24/3.12

(58) Field of Classification Search ..... None
See application file for complete search history.

(56) References Cited

U.S. PATENT DOCUMENTS

| | | | | |
|---|---|---|---|---|
| 2,267,331 | A | 12/1941 | Guyot | |
| 3,262,414 | A * | 7/1966 | Monk | 116/28 R |
| 3,831,398 | A | 8/1974 | Davis | |
| 4,111,343 | A | 9/1978 | Selinko | |
| 5,609,042 | A | 3/1997 | Williams | |
| 6,325,074 | B1 | 12/2001 | Strawn | |
| 2004/0007018 | A1 | 1/2004 | Detsis | |
| 2005/0072188 | A1 | 4/2005 | Kirsh | |

FOREIGN PATENT DOCUMENTS

| | | | |
|---|---|---|---|
| EP | 0286061 | A | 11/1994 |
| EP | 1491111 | A | 12/2004 |
| FR | 2585543 | A | 2/1987 |
| JP | 11129686 | A | 5/1999 |
| JP | 11332618 | A | 12/1999 |

* cited by examiner

*Primary Examiner* — Jack W. Lavinder

(74) *Attorney, Agent, or Firm* — Foley & Lardner LLP; Antoinette F. Konski; Alex Y. Nie

(57) ABSTRACT

The present invention provides a jewellery ornament device for decorating the upper torso region of a user, comprising a clip, and a support for a decoration, the support being detachable from the clip, the clip comprising: a first plate connected to a second plate, the plates being adapted to grip between them a portion of a garment worn by a user, such that when a portion of a garment worn by a user lies substantially flat against the user's body, and the portion of garment is gripped between the second and first plates, the plates limit the movement of the clip about the plane of the portion of the garment, thereby retaining the dip substantially in line with the portion of the garment.

5 Claims, 5 Drawing Sheets

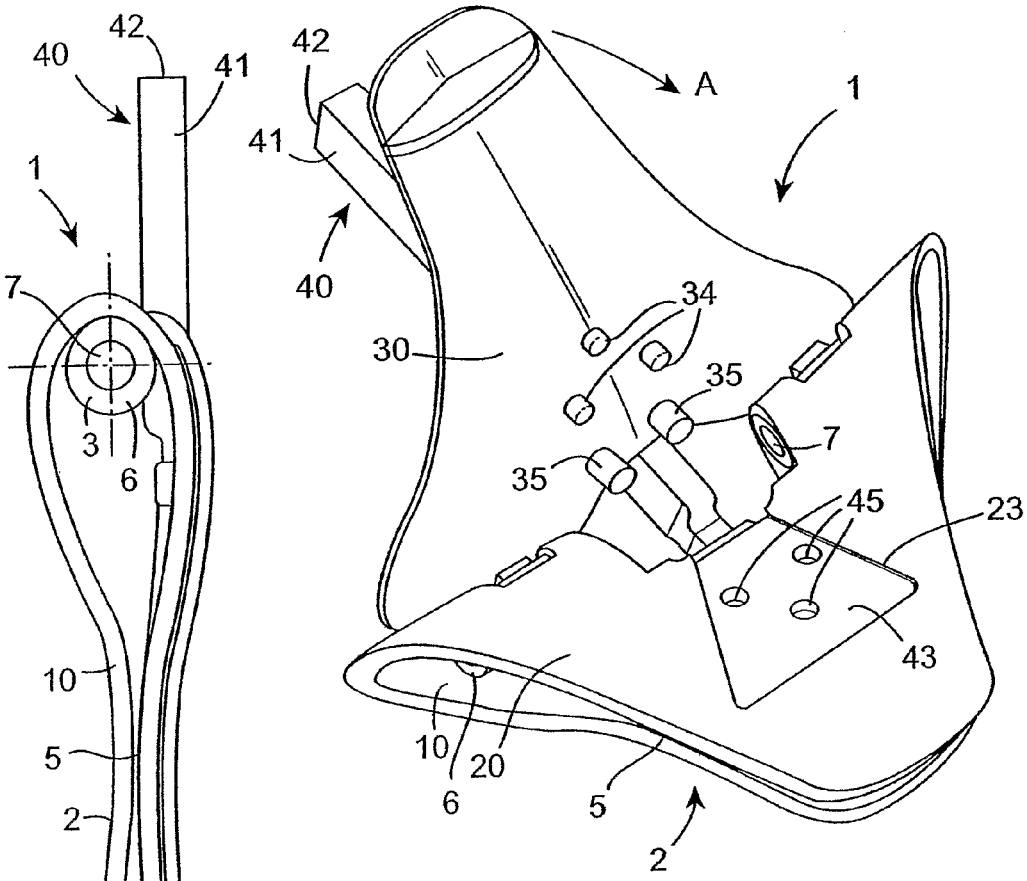
Fig. 1
Fig. 4
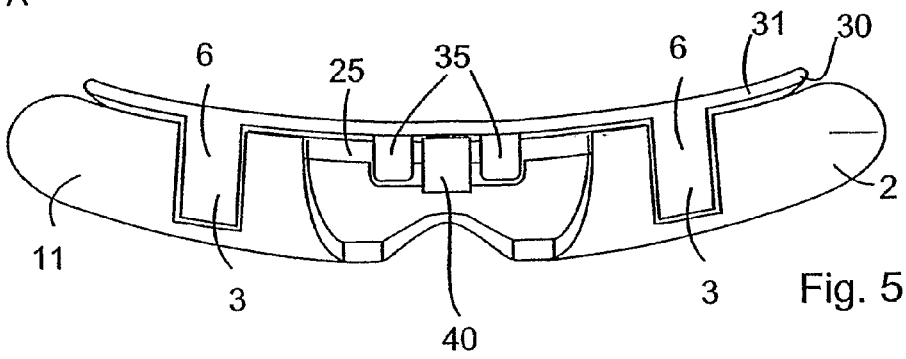
Fig. 5

DECORATIVE JEWELLERY

CROSS-REFERENCE TO RELATED APPLICATIONS

This application is a national stage application under 35 U.S.C. §371 of International Application No. PCT/IE2006/000084, filed Aug. 9, 2006, which in turn claims priority to IE Application No. S2005/0534, filed Aug. 12, 2005, the contents of each of which are incorporated herein by reference in their entireties into the present disclosure.

FIELD OF THE INVENTION

The present invention relates to decorative pieces of jewellery; in particular to items of jewellery that attach to the wearer's clothing and do not encircle the neck.

BACKGROUND OF THE INVENTION

Jewellery and necklaces in particular have been worn since pre-history as a means to decorate the wearer with attractive ornamentation. Necklaces provide a means to adorn the neck, chest and sternum region with decorative jewellery. Necklaces, by definition, encircle the neck of the wearer. In some cases, this can present a drawback in that the clasp of the necklace can be difficult to manipulate, as it is often located at the back of the neck when worn. In addition, a necklace presents certain ornamental constraints, such as the necessity of decorating the neck itself, as well as often predetermining the exact positioning of ornamental features, due to the constraints of gravity. Moreover, as an alternative decorative effect, it can be desirable to decorate the neck, chest and sternum regions without use of a necklace.

US Patent Application US 2004/0007018 attempts to overcome some of these shortcomings of standard necklaces. This application relates to a necklace that does not fully encircle the neck of the user, but instead, takes the form of a length of jewellery with two free ends, wherein each free end is provided with a fixing device so as to enable the two free ends to attach to the wearer's undergarment, such as a brassiere (bra) across the chest region of the user. Favourable embodiments of this invention require a specially adapted bra to be provided with straps adapted for affixing the item of jewellery.

A further solution is proposed in U.S. Pat. No. 5,609,042, which provides a jewellery ornament for accentuating a pair of breasts. The ornament comprises an elongate stem with a mount and decoration at one end and a fastener at the other end for pinning the stem to an article of clothing such as a bra. In use, the ornament is held in place by being wedged in the cleavage defined between a pair of breasts with the decoration being visibly displayed. To aid in this, the ornament typically includes at least one support arm extending laterally from the elongate stem structurally configured to abut the user's breast. One of the disadvantages of this ornament is that its use is limited to those users with sufficient cleavage to securely grip the ornament therebetween. Adhesion is also mentioned as a means to support the ornament. Furthermore, the size, weight and to an extent shape of the ornament are limited by the fact that the ornament is prone to pitching forward from the user, particularly when larger or heavier ornaments are used.

There is therefore a need to provide a non-necklace item of jewellery ornament that can decorate the neck, chest or sternum areas without relying on the body shape of the user or adhesion to remain in situ. It would also be desirable to provide the user with a choice of interchangeable decorations for adorning the article of jewellery.

The concept of interchangeable articles of jewellery is known. U.S. Pat. No. 3,831,398 discloses a small button-like device adapted to receive an ornament on one side, being contoured on the other side and adapted to be detachably secured in the exposed navel of the user. US Application 2005/0072188 discloses a necklace with interchangeable objects for entertaining and pacifying infants and young children.

OBJECT OF THE INVENTION

It is an object of the invention to provide a jewellery ornament that overcomes the shortcomings of the prior art and to provide a further choice in body ornamentation.

SUMMARY OF THE INVENTION

The present invention provides a jewellery ornament device for decorating the upper torso region of a user, comprising a clip, and a support for a decoration, the support being detachable from the clip, the clip comprising:

a first plate connected to a second plate, the plates being adapted to grip between them a portion of a garment worn by a user, such that when a portion of a garment worn by a user lies substantially flat against the user's body, and the portion of garment is gripped between the second and first plates, the plates limit the movement of the clip about the plane of the portion of the garment, thereby retaining the clip substantially in line with the portion of the garment.

In essence, when the support is attached to the clip, the longitudinal gripping action provided by the length of the plates (as measured along the length of a user's body) on the garment provides sufficient support so as to prevent or limit the device from pitching or leaning forward away from the user's body. Additionally, the lateral gripping action provided by the width of the plates provides sufficient support so as to prevent or limit the lateral movement of the device and additionally provide further vertical support so as to limit or prevent forward pitching of the device. In use, the gripping action of the plates acts to limit the side-to-side rotation of the device about the plane of the garment and the pitching forward of the device form the user.

In favourable embodiments of the invention, the plates are roughly triangular in shape, although it will be appreciated that any shape may be given to the plates, provided that sufficient longitudinal and lateral support is provided.

This invention provides advantages in that the clip is adapted to balance the considerable amount of weight suspended on the decorative support, for example, a jewelled ornamentation, which can vary in size and weight based on the numerous designs of ornamentation possible. The clip slides into the item of clothing without the need of piercing, damaging or otherwise altering the fabric. The device is particularly suitable for attachment to portions of garments containing some degree of inherent structural stability. Ideally, the portion of the garment comprises some degree of semi-rigidity. Favourable examples of such means to provide structural stability and/or semi-rigidity include elastication. More preferably, the garment may comprise wire reinforcement, such as those typically found in some bras and undergarments. Preferably, the garment is a bra, and more preferably the portion of the garment to be gripped is the centre portion of the bra located between the bra cups.

Ideally, the support is provided with an ornamentation end for attaching or providing decoration or ornamentation thereon. Thus in some embodiments, a decoration or adornment can be integrally formed with the support. Ideally, the decoration or adornment is integrally formed at the ornamentation end. In further embodiments, a decoration or adornment is attachable at the ornamentation end of the support. The decoration or ornamentation can rise from the support extending from the clip, up the user's chest without the need of further support from the user's neck area. In favourable embodiments, the support comprises a head portion for connection with the clip and an elongate stem extending between the head portion and ornamentation end. The ornamentation end may comprise further decoration or adornment. The skilled person will appreciate that there are a wide variety of methods by which the stem may be reversibly mounted upon the clip, including but not limited to two-part engagement means such as snap-fit, magnetism, screw-and-thread or pin-and-groove. In some embodiments of the invention, the clip and decorative support are integrally formed.

Thus, the invention allows the user to use a number of interchangeable supports presenting various types of ornamentation with a single clip, and similarly, use a number of interchangeable clips with the same or different supports. The latter feature may be advantageous if the user wishes to use a decorated or adorned clip for display, thereby permitting the user a degree of choice in selecting the overall appearance of the clip and support combined.

In preferred embodiments, the second plate further comprises a chamber that is adapted to be reversibly engagable with the head portion. Preferably, the chamber is of the form of an indentation or notch in the second plate. Ideally the chamber is of a complimentary shape to the head portion. In further preferred embodiments, the chamber is wedge shaped, although alternative shapes are possible. Ideally, the chamber has an open-ended portion to allow the elongate stem emerge from the clip. Preferred shapes for the chamber will have a narrower open-ended portion than the widest portion of the head portion. This ensures that the head portion of the support cannot be inserted or removed from the clip through the open-ended portion. This also prevents the user from inserting unsuitable foreign items or wearing the decorative support incorrectly. The chamber may also be provided with a cross-bar, against which the head portion and/or stem abut during use. This may be located across the open-ended portion of the chamber, and can provide support for the stem or head portion during use.

In preferred embodiments of the invention, the invention further comprises a fastener for reversibly securing the head portion to the clip. This embodiment permits the user to insert the head portion into the chamber and then secure the head portion to the clip by closing the fastener over the only available exit route for the head portion, thereby securely and reversibly affixing the support to the clip. Preferably, the fastener is in the form of a flap. The face of the flap that is directable towards the second plate may further comprise a head-engaging means. This provides further means to hold the head portion in place and additionally may be used to ensure that foreign articles of jewellery not specifically adapted for use with the invention cannot be secured by the clip.

The head-engaging means ideally comprises at least one tooth or stud or other similar projection on the inner face that cooperates with at least one complimentary indentation or hole on the head portion. In an alternative embodiment, the head-engaging means may comprise indentations or holes or other female means adapted for receiving projections or other male means on the head portion. The fastener may also be provided with stem pinions to embrace the elongate stem when the fastener is closed over the clip, thereby trapping the stem between the fastener and the cross-bar. Favourably the stem pinions engage with the cross-bar when the fastener is closed.

Preferably, the fastener is mounted, or mountable on the clip. For example, the fastener may be clipped on to the second plate of the clip. In favourable embodiments, the fastener is hingedly mounted to the clip and may further comprise a securing means to secure the fastener to the second plate. The securing means may be a lip or catch or other way of frictionally engaging with the second plate.

In preferred embodiments, the chamber comprises a partial or complete hole or void through the second plate. In such embodiments, the portion of garment that is gripped between the first and second plate will be in direct contact with the head portion of the support, such that the portion of garment and will press the head portion against the fastener, thereby further restraining the support within the clip.

In some embodiments of the invention, securing the fastener to the second plate urges the second plate and first plate together and thereby increases the gripping force of the clip. This can be accomplished by several means, one of which is a biasing means. In some embodiments, the invention further comprises a biasing means engagable with the first plate and the fastener such that when the fastener is secured to the second plate, the second plate and first plate are urged together thereby increasing the gripping force of the clip. The biasing means may be a spring connected to the fastener and the first plate through the hinge.

In favourable embodiments of the invention, the biasing means comprises a spring incorporated into hinges located between the two plates. It is also conceived that the fastener may be attached to the first-plate by means of a spring or other biasing means. In some embodiments, particularly, but not limited to those without a fastener, the head portion can be securely held in the chamber by one or a combination of means such as friction, male-female mating means, clips, magnets, pins and screw threads, such that insertion of the head portion into the chamber additionally urges the second plate and first plate together, thereby increasing the gripping force of the clip. This can be accomplished by, a number of means, such as magnetism, pins, and biasing means.

Preferably, the second plate and first plate are integrally connected and together form an arch- or u-shape. Ideally, a hinge is provided for the fastener where the plates connect. In alternative embodiments, the second plate and first plate may be independently formed. In favourable versions of such embodiments, the second plate and first plate are connectable to each other at the hinge region. Preferably, the two plates are connectable to each other or integrally formed with each other at one complimentary edge of each plate, or along an arc of an ovoid or circular shape.

In some embodiments, the plates are flexibly urged together to create a gripping action between the plates. This can be achieved by biasing means, such as spring urging and/or also by the shape of the clip or the material of the clip. In alternative embodiments, the clip is substantially rigid and the griping force is created by the rigid placement of the two plates relative to each other.

In some embodiments, the first plate is substantially planar so as to lie substantially flat against the user's body profile. In favourable embodiments, the clip and/or decorative support are curved or otherwise ergonomically fashioned so as to lie along the contours of the user's body. Moreover, the second plate and/or fastener may also be substantially laminar or planar so as to minimise the projection of the body from the user. Ideally, the contours and edges of the device are rounded so as to minimise any danger of causing injury or discomfort to the user. In some embodiments the first plate further comprises a soft backing to increase comfort when the device is worn by the user. Favourably, this may comprise felt, cloth, fabric, foam or other soft material.

Ideally, the clip is slightly curved along the lateral length so as to ergonomically fit into the user's sternum region. For example, if the plates are roughly triangular, the base the triangles can be slightly curved (i.e. the two corners of the base are brought out of the plane) about a perpendicular extending from the base to the apex.

Ideally, a complimentary portion of the second and first plates are slightly spaced apart so as to create a mouth through which a portion of garment can pass. In addition, the second plate and first plate may be flexibly urged together at a median portion of the clip so as to grippingly retain a portion of garment therebetween.

In some aspects of the invention, the bases of the plates are spaced apart so as to provide a degree of resilient flexibility to the clip such that when portion of garment is passed through the mouth, and the between gripping area, the resilient flexibility urges the plates together and thereby grips the garment. In some embodiments, the frictional interaction of the lip with second apex causes the second plate and first plate to be further urged together by action of a spring, thereby securing the support within the clip.

In some embodiments, the fastener may close over the clip whether or not the decorative support in inserted into the chamber. This can advantageously permit the user to wear the clip without the decorative support. In alternative embodiments, the clip or fastener is provided with a limiting element that prevents or limits the closure of the fastener when the decorative support is absent. The limiting element may comprise an extendable prong or catch located on one or both of the second plate or the fastener. The extendable prong may be depressable by the action of a portion of the decorative support on a switch, thereby allowing the fastener to close. Ideally, the switch is located in the chamber. For example, the limiting element may reversibly extend outwardly from the second plate, such that the cooperation of a portion of the head portion with a switch located in the chamber causes the jam to retract or become retractable, thereby allowing the fastener to close over the clip. Favourably, the switch is a slidably depressible knob, the depression of which permits the jam to be depressed by the fastener. Such embodiments may favourably be used in conjunction with embodiments requiring the fastener to be closed to effect the maximum gripping action, for example, by means of the action of the biasing means.

The clip and/or decorative support may be at least partly fashioned from one or more precious metals or alloys thereof. The clip and/or decorative support may further comprise the addition of decorative tooling or semi precious and/or precious gems. In some embodiments, one or both of the clip and decorative support are at least partly fashioned from lightweight material, such as aluminium, plastics and so on, and may optionally be painted or coated with ornamental finish or precious metal.

The invention differs from most necklaces in that the decoration adorns the user by rising up the neck area rather than hanging down. The invention does not require the aid of the user's cleavage for support or positioning. The clip allows a decoration or ornamentation attached to the decorative support to rise up the chest area and reach the neck, and in favourable embodiments, permits interchangeable decorative supports to be use with the one clip. The decoration can sit on the shoulder, wrap around the arm, fall down the first or expand to the entire chest area.

The invention also provides for a clip as hereinbefore described, for use with a decorative support as hereinbefore described.

These and other features, objects, and advantages of the present invention will become readily apparent from the following description, pending claims, and accompanying sheets of drawings where:

BRIEF DESCRIPTION OF THE DRAWINGS

FIG. 1: View of a device of the invention, with fastener open.

FIG. 4: Profile view of the device of FIGS. 1-3

FIG. 5: Top view of the device of FIGS. 1-4.

DETAILED DESCRIPTION OF THE DRAWINGS

Figure 2:
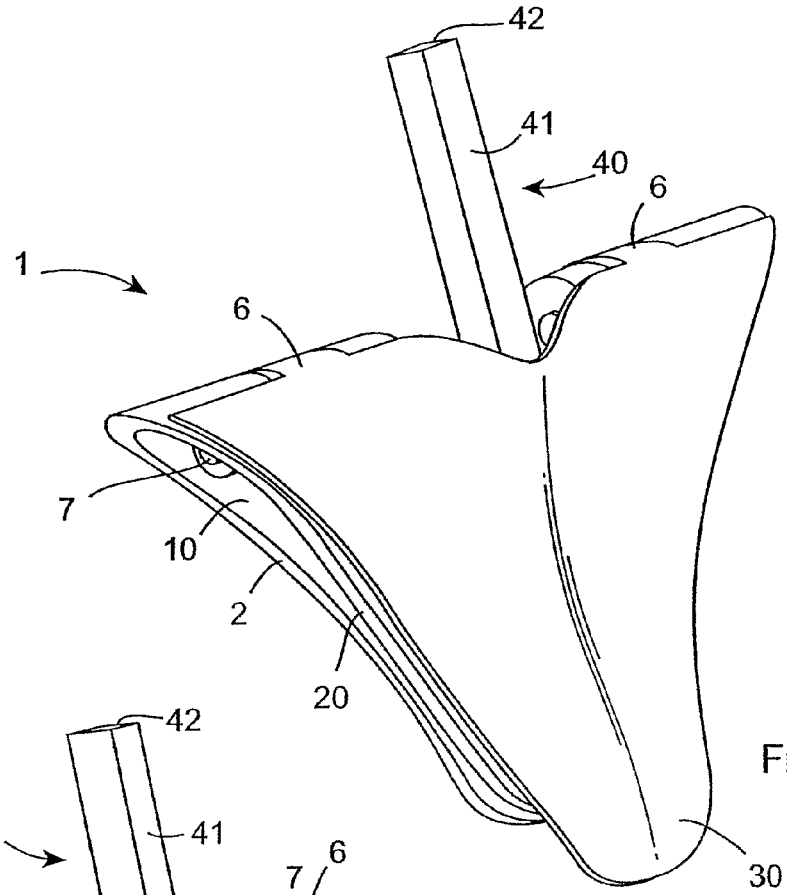
FIG. 2: Front perspective view of the device of FIG. 1 with fastener closed.
Figure 3:
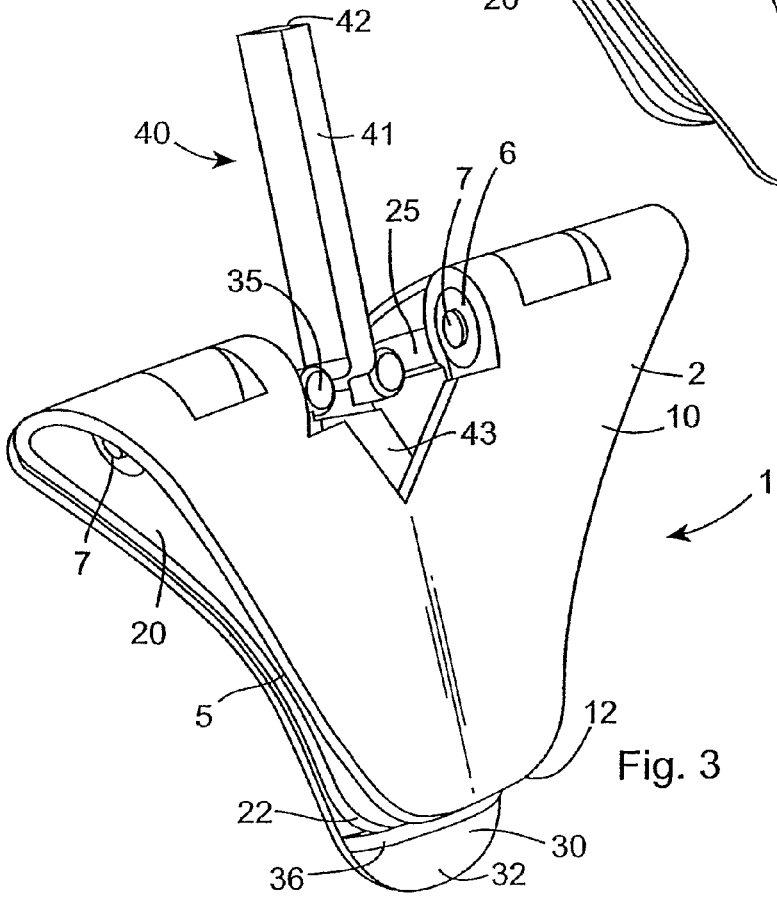
FIG. 3: Rear perspective view of the device of FIGS. 1 and 2.

One embodiment of the invention is generally depicted in FIGS. 1-5. The invention comprises a jewellery ornament device 1, comprising clip 2 made up of a first plate 10 and a second plate 20. The plates are generally triangular in shape and are integrally connected to each other at the base of the triangular portion. A generally triangular-shaped fastener 30 is hingedly connected to the clip 2 and is adapted to close over the clip 2, as shown in FIGS. 2-4, in the direction of the arrow A. The fastener 30 acts to clamp a support 40 within the clip 2. The support 40 comprises an elongate stem 41 extending between an ornamentation end 42 and a head portion 43. The head portion 43 of the support 40 is of complimentary shape to a wedge-shaped chamber 23 in the second plate 20. In use, the head portion 43 is lodged within the chamber 23. The inside face of the fastener 30 is provided with a plurality of studs 34 which cooperatively engage with a plurality of indentations 44 of the head portion 43.

Figure 6:
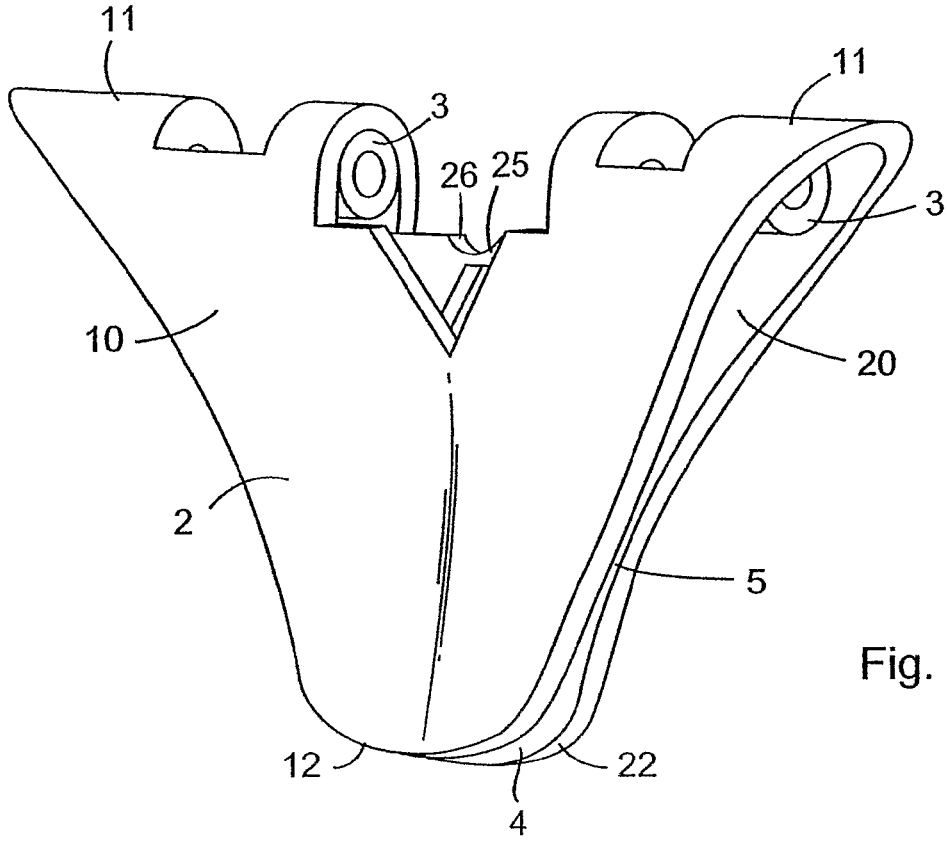
FIG. 6: Front perspective view of a clip for use with the invention.
Figure 7:
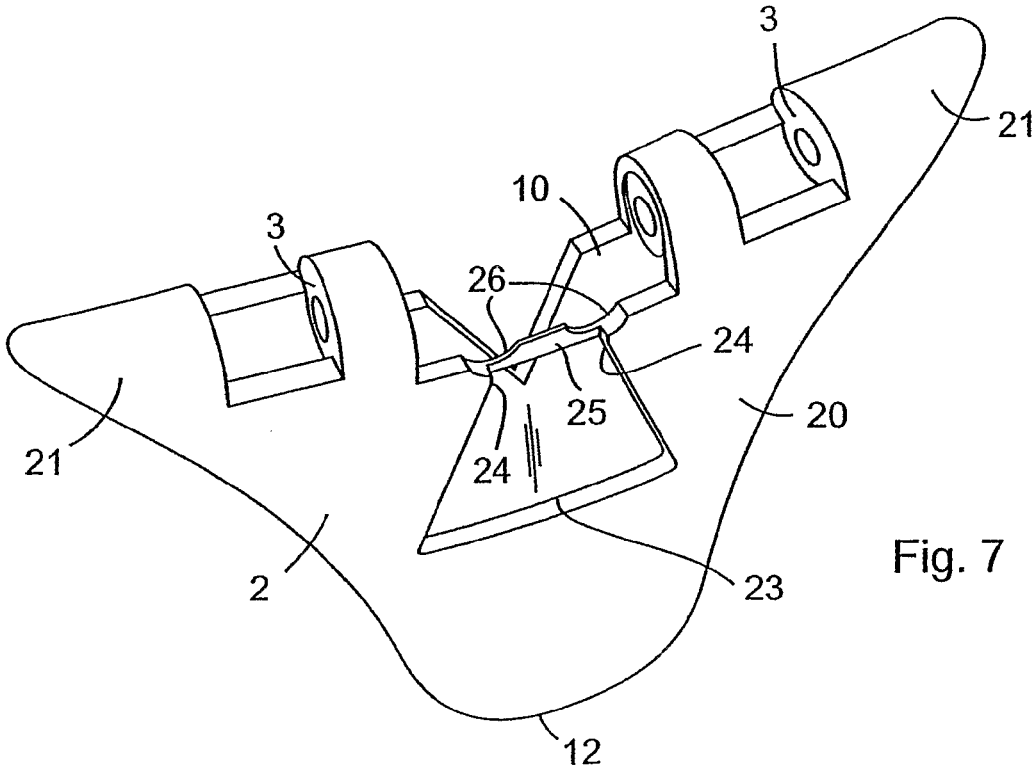
FIG. 7: Rear perspective view of clip of FIG. 6.

FIGS. 6 and 7 show the clip 2 of the invention in greater detail, without the fastener or support. The clip 2 is of a generally triangular shape, formed with a first plate 10 connected to a second plate 20. The first plate 10 is of generally laminar triangular shape and is defined by a first base 11 and a first apex 12. Similarly, the second plate 20 is of generally laminar triangular shape and is defined by a second base 21 and a second apex 22. The two plates are integrally connected at their respective bases 11, 21. Hinge components 3 are provided where the first base 11 and second base 21 connect.

The first apex 12 and second apex 22 are slightly spaced apart, to facilitate passage of a portion of a garment through the mouth 4 between the apexes 12, 22. The planes of the first plate 10 and second plate 20 are slightly bent towards each other approximately parallel to the bases at gripping area 5, located approximately halfway between the bases 11, 21 and apexes 12, 22 of the plates 10, 20. This arrangement allows a portion of garment to pass through the mouth 4 and then be gripped between the first plate 10 and second plate 20.

The bases 11, 21 are set slightly apart from each other. This facilitates the location of the hinge components 3. In some embodiments, this arrangement can urge the plates 10, 20 together and afford greater gripping force between the two plates 10, 20 at the gripping area 5. A chamber 23 is located in the second plate 20. The corners 24 of the chamber 23 make the base-end of the chamber narrower than the apex-end of the chamber. This gives the chamber 23 a wedge shape. A brace in the form of a cross-bar 25 is located across the base-end of the chamber 23. The cross-bar 25 is provided with grooves 26, adapted to engage with prongs 35 (see below, and FIGS. 1 and 3).

Figure 8:
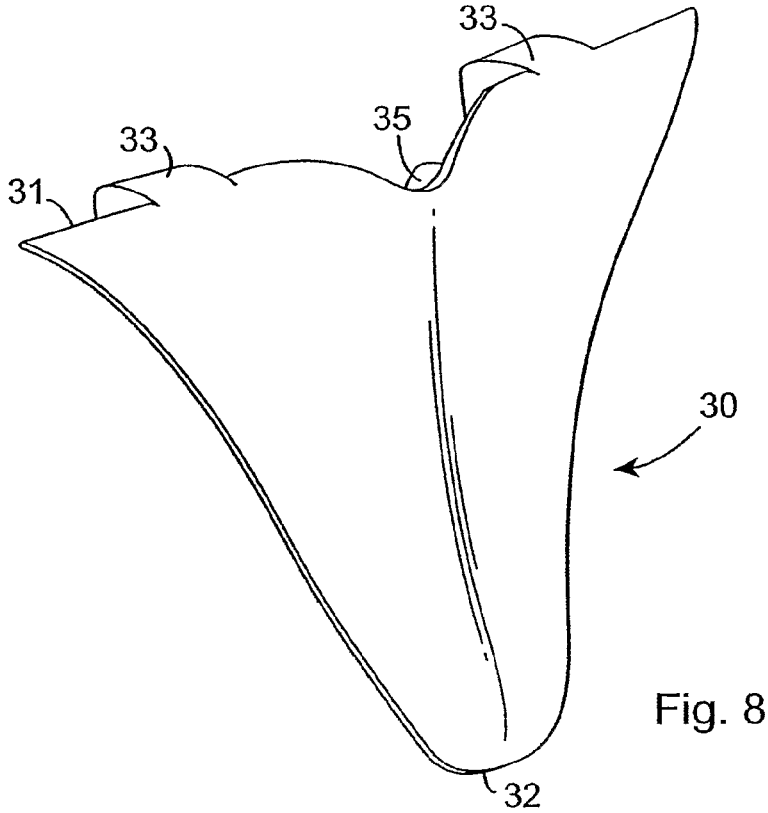
FIG. 8: Front perspective view of a fastener of the present invention.
Figure 9:
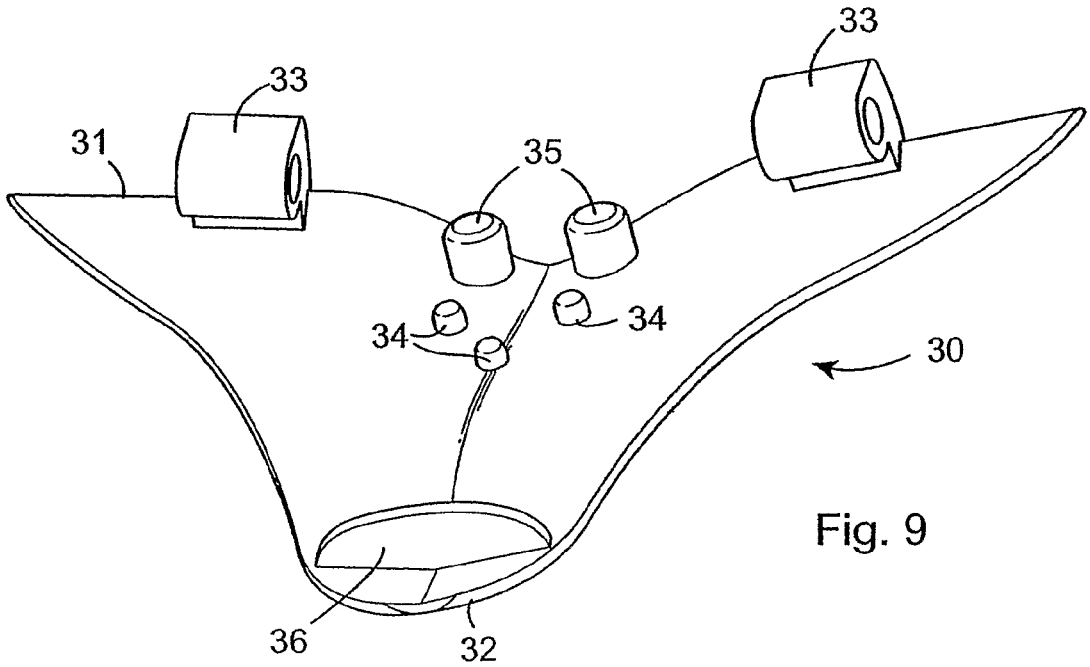
FIG. 9: Rear perspective view of a fastener of FIG. 8.

The fastener 30 is shown in isolation in FIGS. 8 and 9. The fastener 30 is generally in the form of a triangular flap, formed by a fastener base 31 and fastener apex 32, and is of complimentary shape to the clip. Hinge fittings, 33, are provided on the fastener base 31. The fastener 30 is provided with several studs 34 protruding from the inner face of the fastener 30. Two stem-pinions in the form of prongs 35 are located roughly along the fastener base 31. The fastener apex 32 is provided with a lip 36. As shown in FIGS. 1-5, in use, the fastener 30 is mounted on the clip 2, with the hinge fittings 33 and hinge components 3 forming complete hinges 6 in combination with pins 7.

Figure 10:
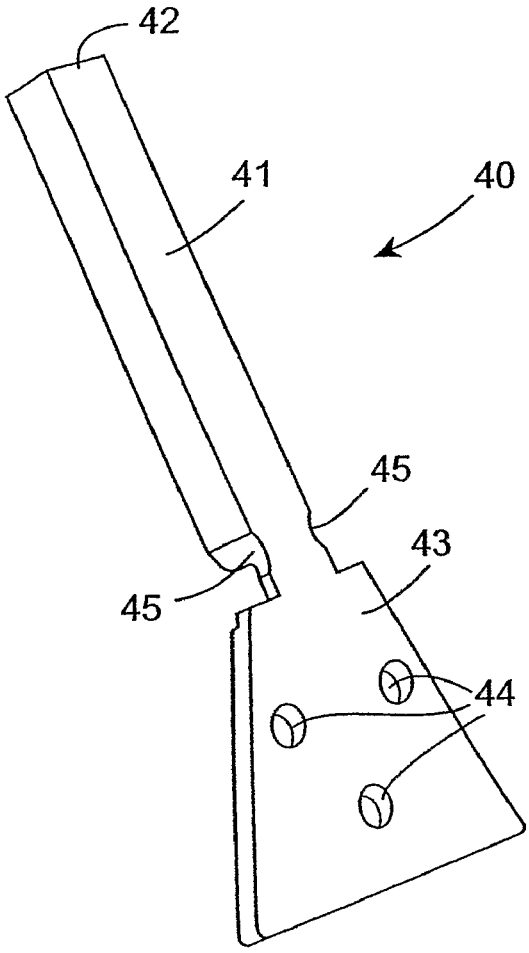
FIG. 10: Perspective view of a support of the present invention.
Figure 11:
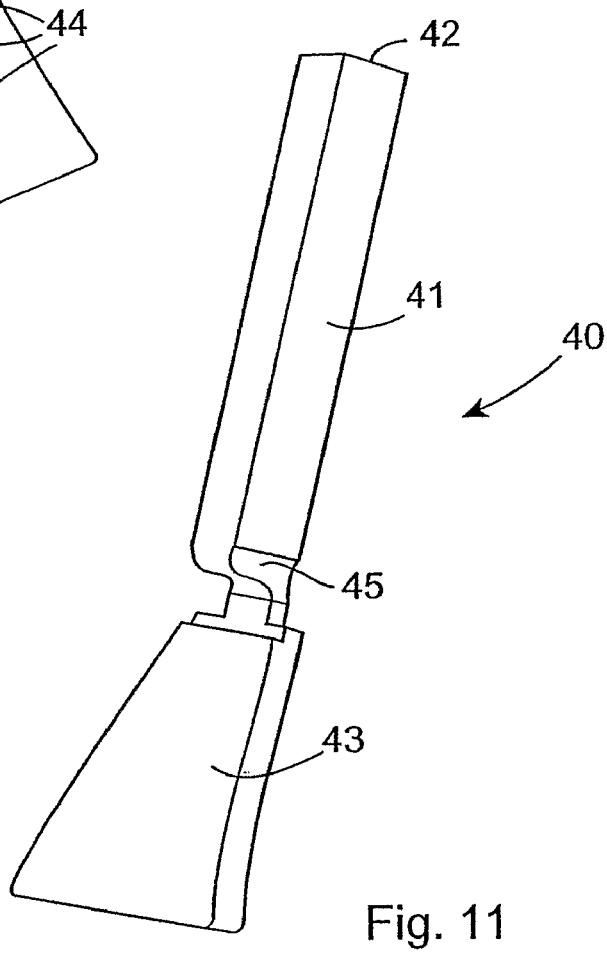
FIG. 11: Rear perspective view of the support of FIG. 10.

Turning to FIGS. 10 and 11, a support 40 is shown. The support 40 is formed by an elongate stem 41 with an ornamentation end 42 and a head portion 43. Indentations 44 are provided on the head portion 43, of complimentary shape and of complimentary disposition to the studs 34 of the fastener 30. In addition, a waist portion 45 is provided between the stem 41 and head portion 43 such that it can fit snugly between the prongs 35, and thereby allow the support 40 to be trapped between the fastener 30 and cross-bar 25 and thus held securely in place in the clip 2 (FIGS. 1-5). In use, the prongs 35 of the fastener rest in the grooves 26 of the cross-bar 25.

The ornamentation end 42 of the support 40 can be fitted with decorations, gems, or other items of jewellery. As can be seen in FIG. 3, when the fastener 30 is closed over the second plate 20 the lip 36 is frictionally engaged with the second apex 22.

In use, exerting pressure on the fastener apex 32 releases the fastener 30 from then clip 2. The chamber 23 is then exposed, allowing the head portion 43 of the support 40 to be removed, or inserted. The corners 24 prohibit the head portion 43 from entering or exiting the chamber 23 through the base end of the chamber 23, and therefore also secure the head portion 43 within the chamber 23 once the fastener 30 is closed. The studs 34 engage with the indentations 44, to hold the head portion 43 securely and also to ensure that foreign objects are not held be the clip 2.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A jewellery ornament device for decorating the upper torso region of a user, comprisinq:

a clip comprising a first plate connected to a second plate, the plates being adapted to grip between them a portion of a garment;

a support for a decoration, the support comprising an elongated stem and a head portion; and a fastener for reversibly securing the support to the clip, the fastener comprising a head-engaging means, wherein the head-engaging means comprises at least one tooth on the face that cooperates with at least one complementary indentation on the head portion.

2. A device as claimed in claim 1 wherein the second plate further comprises a chamber that is adapted to reversibly engage the head portion of the support.

3. A device as claimed in claim 2 wherein the chamber is of a complementary shape to the head portion of the support.

4. A device as claimed in claim 1 wherein the fastener is mounted to the clip by means of a hinge.

5. A jewellery ornament device for decorating the upper torso region of a user, comprising:

a clip comprising a first plate and a second plate, each plate comprising a base and an apex and the second plate further comprising a chamber, wherein the plates are connected to each other at the bases are adapted to grip between them a portion of a garment;

a support for a decoration, the support comprising an elongated stem and a head portion, wherein the head portion is of a complementary shape to the chamber; and a fastener for reversibly securing the head portion of the support in the chamber, wherein when the head portion is secured, the elongated stem of the support extends beyond the clip through an opening between the bases of the plates.

* * * * *